US005762080A

United States Patent [19]

Edwards et al.

[11] Patent Number: 5,762,080

[45] Date of Patent: Jun. 9, 1998

[54] DISHWASHER CYCLE PULSING PUMP OUT OF COLLECTION CHAMBER

[75] Inventors: James M. Edwards, Kinston; John E. Dries, Goldsboro, both of N.C.

[73] Assignee: White Consolidated Industries, Inc., Cleveland, Ohio

[21] Appl. No.: 792,964

[22] Filed: Jan. 24, 1997

[51] Int. Cl.[6] ..... A47L 15/42

[52] U.S. Cl. ..... 134/58 D; 134/104.1; 134/111; 134/115 G; 134/186

[58] Field of Search ..... 134/58 D, 104.1, 134/104.4, 111, 115 G, 186, 188, 191, 195; 241/46.012

[56] References Cited

U.S. PATENT DOCUMENTS

| | | | |
|---|---|---|---|
| 2,024,952 | 12/1935 | Snyder et al. . | |
| 2,729,219 | 1/1956 | Smith, Jr. . | |
| 3,034,519 | 5/1962 | Jacobs . | |
| 3,810,480 | 5/1974 | Smith et al. . | |
| 4,038,103 | 7/1977 | Grunewald . | |
| 4,168,715 | 9/1979 | Spiegal et al. . | |
| 4,201,345 | 5/1980 | Ziegler . | |
| 4,279,384 | 7/1981 | Yamamoto | 134/58 D X |
| 4,350,306 | 9/1982 | Dingler et al. . | |
| 4,795,102 | 1/1989 | Jordan et al. . | |
| 4,848,382 | 7/1989 | Bertsch et al. | 134/111 |
| 4,972,861 | 11/1990 | Milocco et al. | 134/111 X |
| 5,097,855 | 3/1992 | Martinsson et al. . | |
| 5,143,306 | 9/1992 | Nilsson . | |
| 5,184,635 | 2/1993 | Tromblee et al. . | |
| 5,320,120 | 6/1994 | Hoffman et al. . | |
| 5,429,679 | 7/1995 | Young, Jr. . | |

FOREIGN PATENT DOCUMENTS

| | | | |
|---|---|---|---|
| 2657764 | 6/1978 | Germany | 134/111 |
| 2737440 | 2/1979 | Germany | 134/104.1 |
| 2745645 | 4/1979 | Germany . | |
| 6-54789 | 3/1994 | Japan . | |

*Primary Examiner*—Philip R. Coe

*Attorney, Agent, or Firm*—Pearne, Gordon, McCoy and Granger LLP

[57] ABSTRACT

A washer for washing objects with liquid. The washer includes a wash chamber adapted for holding objects to be washed. The sump has a pump chamber and a collection chamber, both of which are adapted to hold liquid from the wash chamber. A recirculation pump is operable to move liquid from the pump chamber to the wash chamber. A drain pump is operable to move liquid from the pump chamber and the collection chamber to a drain. A rotatable blade is disposed in the collection chamber and is adapted to mince particles therein. A controller is provided for controlling the operation of the recirculation pump and the drain pump. The controller is operable to turn the drain pump on and off during a wash phase in order to move particles from the collection chamber to the drain. The controller is also operable to turn the drain pump on at the end of the wash phase in order to initiate a drain phase wherein the drain pump drains the sump of liquid.

21 Claims, 2 Drawing Sheets

DISHWASHER CYCLE PULSING PUMP OUT OF COLLECTION CHAMBER

BACKGROUND OF THE INVENTION

This invention relates to washers in general and, more particularly, to dishwashers having a food mincing blade.

Washers, such as domestic dishwashers, have a tub defining a wash chamber wherein items such as dishes are washed. Conventionally, a lower portion of the wash chamber is provided with a sump wherein wash liquid collects. A recirculation pump driven by an electric motor is disposed within the sump. Typically, the electric motor is reversible and also drives a drain pump. During washing and rinsing operations, the recirculation pump recirculates liquid from the sump up to a spray arm. The spray arm is rotatably mounted to a hub and has a plurality of spray jets that distribute wash liquid throughout the wash chamber. Wash liquid from the spray arm removes debris adhering to the items being washed and carries the debris into the sump.

In order to prevent pieces of debris from damaging the recirculation pump, or clogging the spray jets, washers are typically provided with means for preventing pieces of debris from contacting the recirculation pump. In some washers, a fine screen is disposed around the entrance to the sump in order to capture pieces of debris. Such screens, however, need to be frequently cleaned out. Other washers use centrifugal separation to prevent debris from contacting the recirculation pump. Such washers allow wash liquid and debris to directly enter the sump, and then centrifugally separate the debris into a collection chamber using an impeller driven by the electric motor. At the end of a wash cycle, the electric motor is reversed and debris is pumped out of the collection chamber by the drain pump. An example of such a washer is shown in U.S. Pat. No. 4,168,715 to Spiegel et al., which is incorporated herein by reference.

Some washers utilize a cutting blade to comminute debris entering the sump. Commonly, such washers have a grading screen fitted inside an inlet to the recirculation pump. The cutting blade is driven by the electric motor and is positioned upstream of the grading screen. The cutting blade comminutes the debris so that it can pass through the grading screen. The comminuted debris, however, is recirculated throughout the wash chamber and is re-deposited on the items being washed. An example of such a washer is shown in U.S. Pat. No. 4,201,345 to Ziegler incorporated herein by reference.

In order to prevent comminuted debris from being recirculated throughout the wash chamber, some washers with cutting blades centrifugally separate the comminuted debris into a collection chamber, which is emptied at the end of the wash cycle. An example of such a washer is shown in U.S. Pat. No. 4,350,306 to Dingler et al., which is incorporated herein by reference. A washer shown in U.S. Pat. No. 5,499,640 to Kirkland (assigned to the assignee of the present invention and incorporated herein by reference) separates debris into a collection chamber before the debris is comminuted. In Kirkland, the debris is separated into the collection chamber by a filter. The cutting blade is disposed in the collection chamber. In both Kirkland and Dingler, the cutting blade is driven by the electric motor and rotates continuously when the electric motor is energized.

In washers such as those shown in Dingler and Kirkland, the debris is held in the collection chamber for an entire cycle and can become over-macerated. As a result, minute portions of the debris may not separate from the wash liquid and may be recirculated throughout the wash chamber. In addition, some of the macerated debris may adhere to the walls of the collection chamber and remain in the collection chamber after it has been drained.

Based on the foregoing, there is a need in the art for a washer wherein debris is comminuted by a cutting blade, but is not over-macerated.

SUMMARY OF THE INVENTION

It therefore would be desirable, and is an advantage of the present invention, to provide a washer wherein debris is comminuted by a cutting blade, but is not over-macerated. In accordance with the present invention, the washer includes a wash chamber, a sump, a movable blade, a recirculation pump, a drain pump, and a controller. The wash chamber is adapted for holding objects to be washed. The sump has first and second sump chambers adapted to hold liquid from the wash chamber. The recirculation pump is operable to move liquid from the second sump chamber to the wash chamber. The drain pump is operable to move liquid from the sump to a drain. The movable blade is disposed in the first sump chamber and is adapted to mince particles in the first sump chamber. The controller is for controlling the operation of the recirculation pump and the drain pump. The controller is operable to turn the drain pump on and off during a wash phase in order to move particles from the first sump chamber to the drain. The controller is also operable to turn the drain pump on at the end of the wash phase in order to initiate a drain phase wherein the drain pump drains the sump of liquid.

Also provided in accordance with the present invention is a washer having a wash chamber, a sump, a recirculation pump, a drain pump, and a controller. The wash chamber is adapted for holding objects to be washed. The sump is adapted to hold liquid from the wash chamber. The recirculation pump is operable to move liquid from the sump to the wash chamber. The drain pump is operable to move liquid from the sump to a drain. The controller is for controlling the operation of the recirculation pump and the drain pump. The controller is operable to turn the recirculation pump on during a wash phase, and while the recirculation pump is running, to turn the drain pump on and off in order to move particles from the sump to the drain. The controller is also operable to turn the drain pump on at the end of the wash phase in order to initiate a drain phase wherein the drain pump drains the sump of liquid.

Also provided in accordance with the present invention is a washer having a wash chamber, a sump, first and second electric motors, a recirculation pump, a drain pump, and a blade. The wash chamber is adapted for holding objects to be washed. The sump has first and second sump chambers adapted to hold liquid from the wash chamber. The sump has first and second sump chambers adapted to hold liquid from the wash chamber. The first and second electric motors each have a rotatable motor shaft. The recirculation pump is secured to the motor shaft of the first electric motor, and is operable to move liquid from the second sump chamber to the wash chamber. The drain pump is secured to the motor shaft of the second electric motor, and is operable to move liquid from the sump to a drain. The blade is secured to the motor shaft of the first electric motor. The blade is disposed in the first sump chamber and is adapted to mince particles in the first sump chamber.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
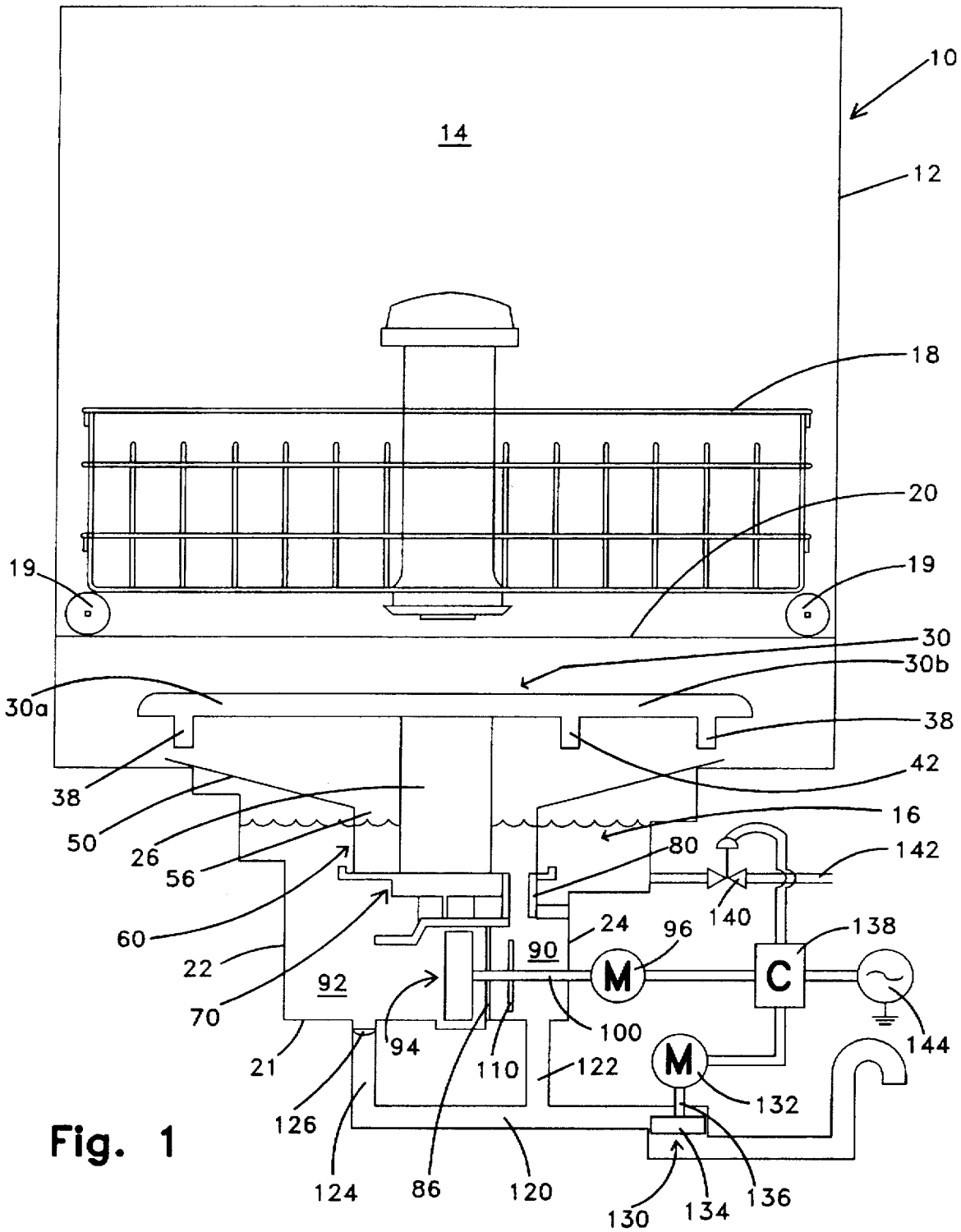
FIG. 1 shows a schematic view of a washer.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
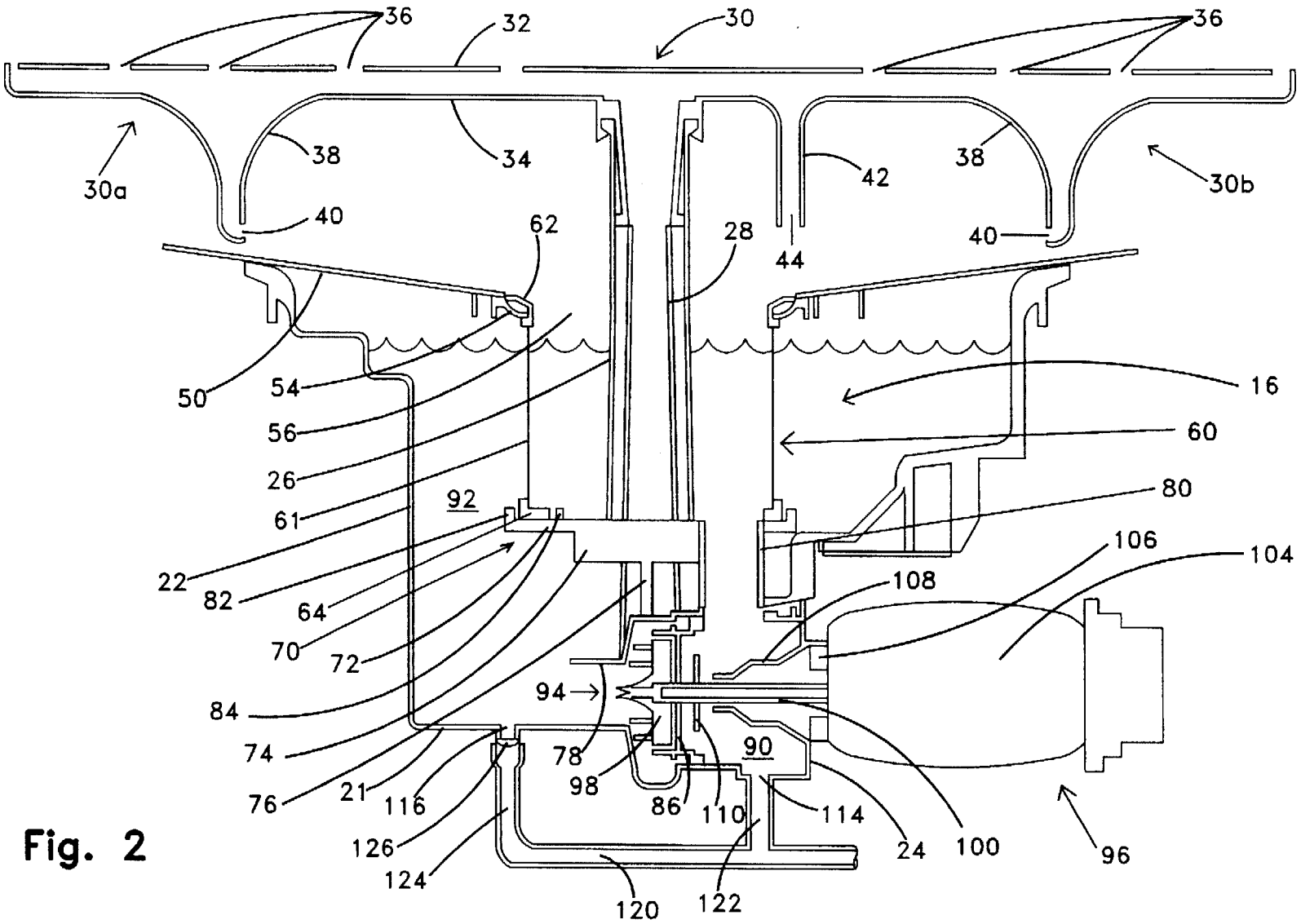
FIG. 2 shows an enlarged side sectional view of a lower portion of the washer.

Referring now to FIGS. 1 and 2 there is respectively shown a schematic view of a washer 10, such as a domestic dishwasher, and an enlarged side sectional view of a lower portion of the washer 10. The washer 10 washes objects, such as dishes, with a wash liquid, such as detergent and water. The washer 10 includes a molded plastic tub 12 defining a wash chamber 14 and a sump 16. A rack 18 for holding objects to be washed is disposed in the wash chamber 14 The rack 18 is generally basket-shaped and has a wire frame construction. The rack 18 is fitted with rollers 19 adapted to track on side wall ridges 20 formed in the tub 12.

The sump 16 is positioned at the bottom of the tub 12, below the wash chamber 14. The sump 16 includes a bottom wall 21, an anterior wall 22, a posterior wall 24, and opposing side walls (not shown). The sump 16 collects and holds wash liquid falling from the wash chamber 14. Extending upward from the sump 16 is a hub 26. The hub 26 encloses a tube 28, which conducts wash liquid up to a spray arm 30.

The spray arm 30 is rotatably mounted to the hub 26. The spray arm 30 is substantially hollow and has a central opening (not shown) that overlays the tube 28. The spray arm 30 is comprised of first and second oppositely directed arm portions 30*a*, 30*b*. Each of the first and second arm portions 30*a*, 30*b* has a top surface 32 and a bottom surface 34. The top surfaces 32 define a plurality of openings; 36. Portions of the openings 36 are upwardly directed and portions are outwardly directed. The outwardly-directed portion of the openings 36 in the first arm portion 30*a* and the outwardly-directed portion of the openings 36 in the second arm portion 30*b* face opposite directions.

Extending downward from the bottom surface 34 of each of the first and second arm portions 30*a*, 30*b* is an outer spray nozzle 38 having an orifice 40 directed inward, towards the hub 26. The outer spray nozzles 38 are respectively located towards the ends of the first and seconds arm portion 30*a*, 30*b*. Extending downward from the bottom surface 34 of the second arm portion 30*b* is an inner spray nozzle 42. The inner spray nozzle 42 is located towards the hub 26 and has a downwardly-directed orifice 44.

An annular outer filter 50 is disposed around the hub 26, below the spray arm 30. The outer filter 50 is preferably composed of molded plastic and defines a plurality of perforations for permitting wash liquid to flow therethrough. The outer filter 50 slopes downwardly to an inner ridge 54. The inner ridge 54 extends radially-inward and slopes downwardly. The inner ridge 54 defines an enlarged circular opening 56, through which the hub 26 extends.

A cylindrical inner filter 60 is disposed around the hub 26, below the outer filter 50. The inner filter 60 is preferably composed of molded plastic and includes a side wall 61 having top and bottom ends. The side wall 61 defines a plurality of perforations (not shown) for permitting wash liquid to flow through the inner filter 60. An annular upper rim 62 is secured to the top end of the side wall 61, while an annular lower rim 64 is secured to the bottom end of the side wall 61. The upper rim 62 defines a notch. The inner ridge 54 of the outer filter 50 is disposed within the notch in the upper rim 62, thereby attaching the inner filter 60 to the outer filter 50 around the opening 56.

Inside the sump 16, the hub 26 is supported on a base 70. The base 70 includes a planar ring 72 joined around a cylindrical body 74. Legs 76 extend downward from the body 74 and support the base 70 on an angled wall 78. The body 74 defines an opening through which the tube 28 extends, while the planar ring 72 defines an opening through which a conduit 80 extends. A flange 82 is disposed around the outer periphery of the planar ring 72 and extends upward therefrom. A plurality of protrusions 84 also extend upward from the planar ring 72 and are spaced radially inward from the flange 82. The lower rim 64 of the inner filter 60 is trapped between the flange 82 and the protrusions 84, thereby attaching the inner filter 60 to the base 70.

A wall 86 is disposed in the sump 16, below the base 70. The wall 86 extends laterally between the side walls of the sump 16, and extends vertically between the angled wall 78 and the bottom wall 21 of the sump 16. The wall 86 separates the sump 16 into a collection chamber 90 and a pump chamber 92. The conduit 80 extends between the inner filter 60 and the collection chamber 90. In this manner, the conduit 80, in conjunction with the inner filter 60, forms a passage through which particles from the wash chamber 14 may travel to the collection chamber 90.

Disposed within the pump chamber 92 is a recirculation pump 94 driven by an electrically-powered first motor 96. The recirculation pump 94 includes an impeller 98 secured to a shaft 100 of the first motor 96. The impeller 98 is disposed within the pump chamber 92, below the angled wall 78 and adjacent to the wall 86. The angled wall 78 forms a pump inlet and defines an opening (not shown) aligned above the impeller 98. The tube 28 extends through the opening in the angled wall 78 and opens into the pump chamber 92.

The first motor 96 includes a housing 104 having an annular fitting 106. The fitting 106 is threadably secured within an opening formed in the posterior wall 24 of the sump 16, thereby securing the first motor 96 to the sump 16. A conical projection 108 is joined to the posterior wall 24 around the opening formed therein. The shaft 100 extends through the conical projection 108 and into the collection chamber 90. The shaft 100 extends through the collection chamber 90 and enters the pump chamber 92 through a bore formed in the wall 86. Within the pump chamber 92, the shaft 100 is secured to the impeller 98.

Within the collection chamber 90, a mincing blade 110 is secured to the shaft 100. The blade 110 is made from a hard, corrosion resistant material, such as stainless steel or aluminum. The blade 110 has sharp edges that chop debris entering the collection chamber 90 through the conduit 80. The edges can be angled slightly from the plane in which the blade 110 rotates for circulating wash liquid and debris within the collection chamber 90 for more efficient mincing.

The bottom wall 21 of the sump 16 respectively defines a first drain opening 114 in the collection chamber 90 and a second drain opening 116 in the pump chamber 92. Both the first drain opening 114 and the second drain opening 116 are connected to a drain line 120. The first drain opening 114 is connected to the drain line 120 through a first outlet line 122, while the second drain opening 116 is connected to the drain line 120 through a second outlet line 124.

A check valve 126 is disposed within the second outlet line 124, towards the second drain opening 116. The check valve 126 opens and closes in response to changes in differential pressure across the check valve 126, i.e., the pressure in the pump chamber 92 minus the pressure in the second outlet line 124. When the differential pressure exceeds a maximum level, the check valve 126 opens to allow wash liquid to flow from the pump chamber 92 into the second outlet line 124. When the differential pressure is less than the maximum level, the check valve 126 closes. In this manner, the check valve 126 only allows wash liquid to flow out of the pump chamber 92 through the second outlet line 124, and does not allow wash liquid to flow into the pump chamber 92 through the second outlet line 124.

Disposed within the drain line 120 is a drain pump 130 driven by an electrically-powered second motor 132. The drain pump 130 includes an impeller 134 secured to a shaft 136 of the second motor 132. When running, the drain pump 130 draws wash liquid out of the first and second outlet lines 122, 124 and the collection chamber 90, and pumps the wash liquid through the drain line 120 to a drain (not shown). After a period of time, the operation of the drain pump 130 increases the differential pressure across the check valve 126 above the maximum level, thereby causing the check valve 126 to open. As a result, wash liquid from the pump chamber 92 flows into the second outlet line 124 and is pumped through the drain line 120 to the drain.

The starting and stopping of the recirculation pump 94 and the drain pump 130 is controlled by a controller 138. The controller 138 also controls a solenoid fill valve 140 disposed within a supply line 142 connecting the sump 16 to a supply of wash liquid, such as a water pipe. The controller 138 is an electro-mechanical controller or a programmable controller, both of which are known in the prior art. An example of an electro-mechanical controller which can be used with the present invention is disclosed in U.S. Pat. No. 5,494,062 to Springer, which is assigned to the assignee of the present invention, and which is incorporated herein by reference. The controller 138 is connected between the fill valve 140 and the first and second motors 96, 132, and a power source 144 such as a household alternating current supply.

At the beginning of a first wash phase, the controller 138 supplies electric power to the fill valve 140, thereby causing the fill valve 140 to open and wash liquid to enter the sump 16 through the supply line 142. After a period of time, the controller 138 cuts off electric power to the fill valve 140, thereby causing the fill valve 140 to close. The controller 138 then turns the recirculation pump 94 on by supplying electric power to the first motor 96. The first motor 96 rotates the shaft 100 and, thus, the impeller 98. The impeller 98 draws wash liquid from the pump chamber 92 and pumps it up through the tube 28 into the spray arm 30. Sprays of wash liquid project from the upwardly-directed portions of the openings 36 and impinge upon the objects held in the rack 18, loosening debris, such as food, adhering thereto. Sprays of wash liquid also project from the outwardly-directed portion of the openings 36. Since the outwardly-directed portion of the openings in the first arm portion 30*a* face in an opposite direction from the outwardly-directed portion of the openings 36 in the second arm portion 30*b*, a net reaction force is created by the sprays of wash liquid projecting from the outwardly-directed portions of the openings 36. The net reaction force rotatably drives the spray arm 30 at a predetermined rate.

Most of the wash liquid and debris falling from the wash chamber 14 contacts the outer filter 50. A portion of the wash liquid and debris, however, passes through the opening 56 in the outer filter 50 and enters the inner filter 60. Wash liquid that contacts the outer filter 50 passes through the outer filter 50 and enters the pump chamber 92. Debris that contacts the outer filter 50, however, is entrained by the outer filter 50.

The outer spray nozzles 38 operate to project filter-cleaning sprays of wash liquid onto the outer filter 50. The filter-cleaning sprays project inwardly from the orifices 40 in the outer spray nozzles 38 and impinge upon the outer filter 50, propelling debris entrained therein towards the opening 56 in the outer filter 50. The debris dislodged by the horizontal sprays is propelled into the inner filter 60 through the opening 56 by a downwardly-directed spray of wash liquid projecting from the orifice 44 in the inner spray nozzle 42.

Wash liquid entering the inner filter 60 can flow through the side wall 61 and into the pump chamber 92. Debris entering the inner filter 60, however, cannot pass through the side wall 61 and falls downward, toward the base 70 and the conduit 80. Debris passes through the conduit 80 and enters the collection chamber 90. Inside the collection chamber 90, the debris is chopped up or minced by the mincing blade 110, which is rotated by the operation of the recirculation pump 94.

After approximately seventy-five percent (75%) of the first wash period has elapsed, the controller 138 turns the drain pump 130 on for a brief period of time, such as three (3) seconds. The controller turns the drain pump 130 on by supplying electric power to the second motor 132. The second motor 132 rotates the shaft 136 and, thus, the impeller 134. The impeller 134 draws wash liquid and minced debris out of the collection chamber 90 and pumps it through the drain line 120 to the drain.

During the brief period of time the drain pump 130 is running, the controller 138 continues to provide electric power to the first motor 96. Consequently, the recirculation pump 94 continues to pump wash liquid up to the spray arm 30, thereby reducing the pressure in the pump chamber 92. This reduction in pressure delays the increase in differential pressure across the check valve 126 caused by the operation of the drain pump 130. As a result, the check valve 126 remains substantially closed during the pulsing of the drain pump 130. In this manner, the amount of wash liquid discarded to the drain with the debris is minimized.

At the end of the brief period of time, the controller 138 turns the drain pump 130 off by cutting power to the second motor 132. By pulsing the drain pump 130, i.e., turning the drain pump 130 on for the brief period of time and then turning it off, the controller 138 clears the collection chamber 90 of debris without discarding a significant amount of wash liquid. Clearing the collection chamber 90 of debris prevents the collection chamber 90 from over-filling with debris and prevents the debris from becoming over-macerated.

It should be appreciated that the portion of the first wash phase that elapses before the drain pump 130 is pulsed is not limited to seventy-five percent. The drain pump 130 can be pulsed before seventy-five percent of the first wash period elapses or after seventy-five percent of the first wash period elapses. The amount of time that elapses before the drain pump 130 is pulsed is selected so as to be long enough to enable the collection chamber 90 to fill with debris without being too long so as to cause the collection chamber 90 to overfill with debris. Through experimentation, it was found that the drain pump 130 is pulsed after preferably seventy-five percent of the first wash period has elapsed.

It should also be appreciated that the brief period of time the drain pump 130 is pulsed on is not limited to three (3) seconds. The brief period of time can be less than three seconds or greater than three seconds. The brief period of time is selected so as to be long enough to clear debris from the collection chamber 90 without being too long so as to unnecessarily discard too much wash liquid. Through experimentation, it was found that the brief period of time is preferably between three and four seconds.

After the drain pump 130 is pulsed, the controller 138 keeps the recirculation pump 94 running. The recirculation pump 94 continues to pump wash liquid up to the spray arm 30, and the spray arm 30 continues to spray wash liquid onto the objects in the rack 13. As a result, debris continues to be removed from the objects being washed, albeit in lesser amounts. If the objects being washed are heavily soiled, larger amounts of debris will continue to be deposited in the collection chamber 90. For this reason, the controller 138 can be programmed to initiate additional pulsing of the drain pump 130 to clear the collection chamber 90 of debris.

At the end of the first wash phase, the controller 138 starts a first drain phase by turning the drain pump 130 on. The controller 138 keeps the recirculation pump 94 running during the drain phase for an extra period of time. The drain pump 130 pumps debris and wash liquid out of the collection chamber 90 and, after a period of time, increases the differential pressure across the check valve 126 above the maximum level, thereby causing the check valve 126 to open. Thereafter, wash liquid from the pump chamber 92 flows into the second outlet line 124 and is pumped through the drain line 120 to the drain. As a result, the level of wash liquid in the sump 16 drops to expose the inner filter 60.

The controller 138 keeps the recirculation pump 94 running in order to maintain the filter-cleaning sprays of wash liquid from the outer spray nozzles 38 and the downwardly-directed spray of wash liquid from the inner spray nozzle 42. The filter-cleaning sprays and the downwardly-projecting spray dislodge debris left behind on the inner filter 60 by the receding level of wash liquid. The dislodged debris is propelled into the collection chamber 90 where it is chopped up by the mincing blade 110. The minced debris is then pumped out to the drain by the drain pump 130.

After the extra period of time, the controller 138 turns the recirculation pump 94 off and allows the drain pump 130 to continue running. The controller 138 turns the recirculation pump 94 off because the falling level of wash liquid in the sump 16 would cause the recirculation pump 94 to lose its prime.

The drain pump 130 runs for a drain period of time that allows substantially all of the wash liquid to be pumped out of the sump 16 and into the drain. At the end of the drain period of time, the controller 138 stops the drain pump 130. Thereafter, a second wash phase can be started by the controller 138. In the second wash phase, as well as in other subsequent wash phases, the drain pump 139 can be pulsed to clear the collection chamber 90.

Although the preferred embodiment of this invention has been shown and described, it should be understood that various modifications and rearrangements of the parts may be resorted to without departing from the scope of the invention as disclosed and claimed herein.

What is claimed is:

1. A washer for washing particles off of objects with liquid, said washer comprising:

a wash chamber adapted for holding objects to be washed;

a sump having first and second sump chambers adapted to hold liquid from the wash chamber;

a recirculation pump operable to move liquid from the second sump chamber to the wash chamber;

a drain pump operable to move liquid from the sump to a drain;

a movable blade disposed in the first sump chamber and adapted to mince particles in the first sump chamber; and a controller for controlling the operation of the recirculation pump and the drain pump, said controller being operable to turn the drain pump on and off during a wash phase in order to move particles from the first sump chamber to the drain, said controller being operable to turn the drain pump on at the end of the wash phase in order to initiate a drain phase wherein the drain pump drains the sump of liquid.

2. The washer of claim 1 further comprising first and second electric motors for respectively driving the recirculation pump and the drain pump.

3. The washer of claim 2 wherein the controller controls the recirculation pump and the drain pump by respectively controlling electric power to the first and second electric motors.

4. The washer of claim 2 wherein the blade is rotated by the first electric motor.

5. The washer of claim 1 further comprising a drain line connected to the first sump chamber and the second sump chamber.

6. The washer of claim 5 wherein the drain pump is disposed within the drain line.

7. The washer of claim 1 wherein the recirculation pump is disposed in the second sump chamber.

8. The washer of claim 1 wherein the controller is operable to turn the recirculation pump on during the wash phase, and to keep the recirculation pump running until the end of the wash phase.

9. The washer of claim 8 wherein the controller is operable to keep the recirculation pump running while the drain pump is draining the sump of liquid during the drain phase.

10. The washer of claim 1 wherein the controller is an electro-mechanical controller.

11. A washer for washing particles off of objects with liquid, said washer comprising:

a wash chamber adapted for holding objects to be washed;

a sump adapted to hold liquid from the wash chamber;

a recirculation pump operable to move liquid from the sump to the wash chamber;

a drain pump operable to move liquid from the sump to a drain; and a controller for controlling the operation of the recirculation pump and the drain pump, said controller being operable to turn the recirculation pump on during a wash phase, and while the recirculation pump is running, to turn the drain pump on and off in order to move particles from the sump to the drain, said controller being operable to turn the drain pump on at the end of the wash phase in order to initiate a drain phase wherein the drain pump drains the sump of liquid.

12. The washer of claim 11 further comprising a movable blade disposed in the sump and adapted to mince particles in the sump.

13. The washer of claim 12 wherein the sump has a first sump chamber wherein the blade is disposed, and a second sump chamber wherein the recirculation pump is disposed.

14. The washer of claim 13 further comprising:

a first electric motor for driving the recirculation pump and rotating the blade; and a second electric motor for driving the drain pump.

15. The washer of claim 11 further comprising an annular filter disposed over the sump.

16. The washer of claim 11 wherein the controller is operable to keep the recirculation pump running while the drain pump is draining the sump of liquid during the drain phase.

17. A washer for washing particles off of objects with liquid, said washer comprising:

a wash chamber adapted for holding objects to be washed;

a sump having first and second sump chambers adapted to hold liquid from the wash chamber;

first and second electric motors each having a rotatable motor shaft;

a recirculation pump secured to the motor shaft of the first electric motor, said recirculation pump being operable to move liquid from the second sump chamber to the wash chamber;

a drain pump secured to the motor shaft of the second electric motor, said drain pump being operable to move liquid from the sump to a drain; and a blade secured to the motor shaft of the first electric motor and disposed in the first sump chamber, said blade being adapted to mince particles in the first sump chamber.

18. The washer of claim 17 further comprising a controller for controlling electric power to the first and second electric motors, said controller being operable to connect and disconnect electric power to the second electric motor during a wash phase so as to activate the drain pump for a period of time and thereby pump particles out of the first sump chamber and into the drain, said controller being operable to re-connect electric power to the second electric motor at the end of the wash phase so as to initiate a drain phase wherein the drain pump drains the sump of liquid.

19. The washer of claim 17 further comprising:

a first outlet line connected to the first sump chamber;

a second outlet line connected to the second sump chamber; and a drain line connecting the first and second outlet lines to a drain, said drain line accommodating the drain pump.

20. The washer of claim 19 further comprising a check valve disposed in the second outlet line, said check valve being operable to permit liquid to flow from the second sump chamber to the drain line when the drain pump is running, while preventing liquid from flowing into the second sump chamber from the drain line.

21. The washer of claim 17 further comprising:

an outer filter disposed over the sump, said outer filter being annular shaped and defining a central opening;

a cylindrical inner filter having top and bottom portions, said top portion being attached to the outer filter around the central opening;

a base attached to the bottom portion of the inner filter and defining a bottom opening; and a conduit extending from the bottom opening in the base to the first sump chamber, said conduit, in conjunction with the inner filter, forming a passage through which particles from the wash chamber may travel to the first sump chamber.

* * * * *

UNITED STATES PATENT AND TRADEMARK OFFICE

CERTIFICATE OF CORRECTION

PATENT NO. : 5,762,080

DATED : June 9, 1998

INVENTOR(S) : Edwards et al.

It is certified that error appears in the above-identified patent and that said Letters Patent is hereby corrected as shown below:

Column 3, Line 24, after "14" insert --.-- (period).

Column 7, Line 16, delete "13" and insert --18--.

Signed and Sealed this

Thirteenth Day of October 1998

*Attest:*

*Attesting Officer*

Bruce Lehman

BRUCE LEHMAN

*Commissioner of Patents and Trademarks*

Adverse Decisions In Interference

Patent No. 5,762,080, James M. Edwards, John E. Dries, DISHWASHER CYCLE PULSING PUMP OUT OF COLLECTION CHAMBER, Interference No. 104,439, final judgment adverse to the patentees rendered February 9, 2000, as to claims 11, 12, 15 and 16.

*(Official Gazette May 2, 2000)*